US006904973B2

(12) United States Patent
Tieben

(10) Patent No.: US 6,904,973 B2
(45) Date of Patent: Jun. 14, 2005

(54) DOWNHOLE PUMP

(75) Inventor: James B. Tieben, Dodge City, KS (US)

(73) Assignee: My-D Han-D Company, Dodge City, KS (US)

( * ) Notice: Subject to any disclaimer, the term of this patent is extended or adjusted under 35 U.S.C. 154(b) by 63 days.

(21) Appl. No.: 10/405,382

(22) Filed: Apr. 2, 2003

(65) Prior Publication Data

US 2004/0194964 A1 Oct. 7, 2004

(51) Int. Cl.[7] ..... E21B 43/00
(52) U.S. Cl. ..... 166/369; 166/105
(58) Field of Search ..... 166/369, 68, 68.5, 166/105, 108, 110

(56) References Cited

U.S. PATENT DOCUMENTS 1,579,587 A * 4/1926 Willers ..... 166/105
2,222,823 A 11/1940 Parenti
2,612,841 A 10/1952 Lasley
4,480,685 A 11/1984 Gilbertson
4,682,655 A 7/1987 Rivas
4,768,589 A 9/1988 Roeder
4,934,907 A 6/1990 Kroner
5,314,025 A 5/1994 Priestly
5,429,193 A 7/1995 Hegebarth et al.
5,807,082 A * 9/1998 Skinner et al. ..... 417/375
6,164,376 A * 12/2000 Stuebinger et al. ..... 166/105.5
6,368,084 B1 4/2002 Skillman

* cited by examiner

*Primary Examiner*—William Neuder
(74) *Attorney, Agent, or Firm*—Brinks Hofer Gilson & Lione

(57) ABSTRACT

A downhole pump includes a pump barrel defining a pumping chamber having a first end and a second end, a first one-way valve positioned at the first end of the pumping chamber, a second one-way valve positioned at the second end of the pumping chamber and a plunger movable disposed in the pumping chamber. The first one-way valve is operable to permit a flow of fluid out of the first end of the pumping chamber, while the second one-way valve is operable to permit a flow of fluid out of the second end of the pumping chamber. The plunger has first and second ends facing the first and second ends of said pumping chamber respectively. The pumping chamber has an inlet adapted to be in flow communication with a production zone. The plunger is movable in the pumping chamber between at least a first position and a second position. The second end of the plunger is positioned on a first side of the inlet when the plunger is in the first position such that the inlet is in flow communication with the second end of the pumping chamber. The first end of the plunger is positioned on a second side of the inlet when the plunger is in the second position such that the inlet is in flow communication with the first end of the pumping chamber. An inlet member and a method of pumping fluid from a production zone located beneath the surface of the earth are also provided.

22 Claims, 4 Drawing Sheets

DOWNHOLE PUMP

BACKGROUND

The present invention relates generally to a downhole pump, and in one particular embodiment, to a double stroke downhole pump.

Typically, downhole pumps include a hollow plunger sliding up and down within a polished barrel to lift fluids, such as oil and water, to the surface. Usually, the fluid is forced through a check valve located at the bottom end of the plunger on the downstroke of the plunger. On the upstroke, the check valve on the plunger is closed and the plunger lifts the fluid upward. At the same time, more fluid is drawn into a chamber in barrel through a check valve located in the bottom of the barrel. In this operation, the pump is required to lift both the weight of the plunger, a rod string attached to the plunger and the oil.

In other arrangements, shown for example in U.S. Pat. No. 5,314,025 to Priestly and U.S. Pat. No. 6,368,084 to Skillman, the check valves and plunger are arranged such that fluids are pumped on the downstroke of the plunger. However, such pumps do not pump any fluid on the upstroke and are susceptible to gas lock. Moreover, the Priestly and Skillman patents disclose that the oil is forced upwardly through the plunger on the downstroke, which can reduce the capacity of the pump. In addition, Priestly further discloses that various seals are required between the plunger and/or rod string and the pump casing.

BRIEF SUMMARY

Briefly stated, in one aspect, one embodiment of a downhole pump includes a pump barrel defining a pumping chamber having a first end and a second end, a first one-way valve positioned at the first end of the pumping chamber, a second one-way valve positioned at the second end of the pumping chamber and a plunger movable disposed in the pumping chamber. The first one-way valve is operable to permit a flow of fluid out of the first end of the pumping chamber, while the second one-way valve is operable to permit a flow of fluid out of the second end of the pumping chamber. The plunger has first and second ends facing the first and second ends of said pumping chamber respectively. The pumping chamber has an inlet adapted to be in flow communication with a production zone. The plunger is movable in the pumping chamber between at least a first position and a second position. The second end of the plunger is positioned on a first side of the inlet when the plunger is in the first position such that the inlet is in flow communication with the second end of the pumping chamber. The first end of the plunger is positioned on a second side of the inlet when the plunger is in the second position such that the inlet is in flow communication with the first end of the pumping chamber.

In preferred embodiment, the plunger operates only in the lower portion of the barrel. In this embodiment, the plunger pumps fluid out of the pumping chamber and into the production tube on the downstroke.

In another aspect, an inlet member for use in a downhole pump includes a housing having an exterior side surface, a first end, a second end, an interior pumping passageway formed therein between the first and second ends, at least one fluid passageway formed therein between the first and second ends, and at least one inlet passageway communicating between the exterior side surface of the housing and the interior pumping passageway. The at least one fluid passageway is in fluid flow isolation with the interior pumping passageway and the inlet passageway.

In yet another aspect, a method of pumping fluid from a production zone located beneath the surface of the earth includes positioning a plunger in a first position wherein a second end of the plunger is positioned on a first side of an inlet and allowing a first volume of fluid to flow into a pumping chamber from the inlet. The method further includes moving the plunger in a second direction and thereby forcing at least a portion of the first volume of fluid from the pumping chamber through the second one-way valve positioned at the second end of the pumping chamber. The method also includes positioning the plunger in a second position wherein the first end of the plunger is positioned on a second side of the inlet and allowing a second volume of fluid to flow into the pumping chamber from the inlet. The method further includes moving the plunger in the first direction and thereby forcing at least a portion of the second volume of fluid through the first one-way valve positioned at the first end of the pumping chamber.

The various aspects and embodiments provide significant advantages over other downhole pumps. For example and without limitation, the weight of the rod string and plunger are sufficient to pump the fluids during the downstroke. In addition, the downstroke flushes any sand or debris that have entered the pumping chamber of the barrel to be flushed therefrom, thereby preventing unnecessary wear on the barrel. Moreover, in one embodiment, the double-stroke pump pumps fluid on both the downstroke and upstroke, thereby increasing the capacity of the pump. In addition, the configuration of the pump avoids gas lock. Moreover, the system avoids the need for various seals between the plunger/rod string and the barrel. Finally, as production of the well decreases, the pumping mechanism at the surface can be reset so that only the lower portion of the barrel, which is the most efficient, is used.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
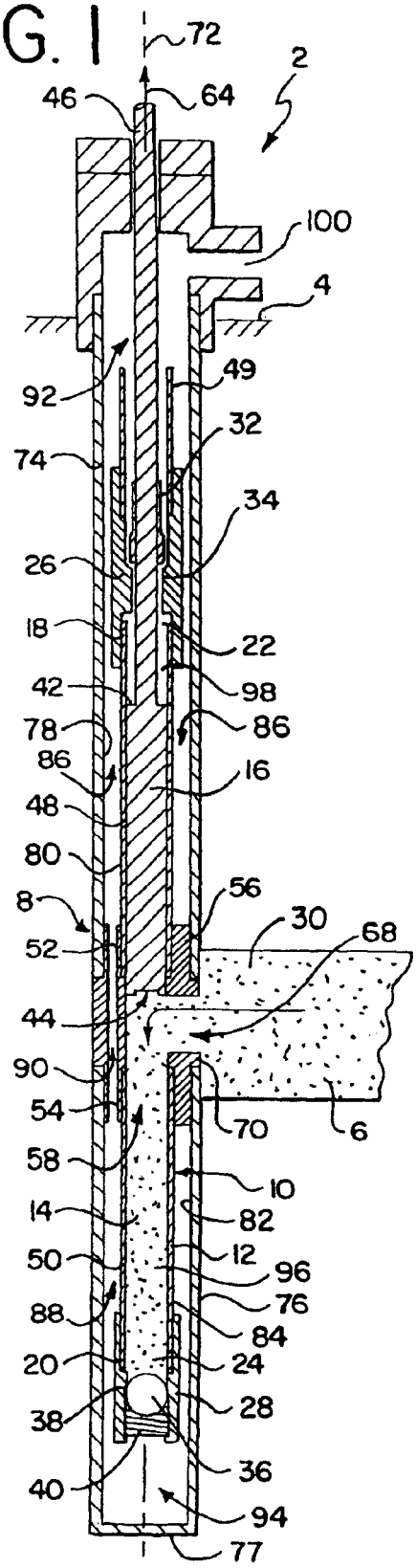
FIG. 1 is a cross-sectional side view of a downhole pump with the plunger positioned in a first position proximate the top of the stroke.

Referring to FIGS. 1–4, a dowuhole pump assembly 2 is shown positioned beneath the surface 4 of the earth in communication with a production zone 6 of fluid 30. The term "fluid" should be broadly interpreted to mean any fluid, including oil and water. The downhole pump assembly includes a production tube 8 and a pump 10 positioned within the production tube. The pump 10 includes a barrel 12 defining a pumping chamber 14 and a plunger 16 movably disposed in the pumping chamber 14. The barrel 12 and pumping chamber 14 each have first and second ends 18, 20, 22, 24, with a first one-way valve 26 connected to the first end 18 of the barrel at the first end 22 of the pumping chamber and a second one-way valve 28 connected to the second end 20 of the barrel at the second end 24 of the pumping chamber.

The first and second one-way valves 26, 28, shown as check valves, are arranged to permit one-way flow of fluid 30 out of the first and second ends 22, 24 of the pumping chamber respectively. The first one-way valve 26 preferably includes a valve seat 34 and a valve member 32 moveable relative thereto. The second one-way valve 28 includes a valve seat 38 and a valve member 36 moveable relative thereto. The second one-way valve also preferably includes a spring 40 biasing the valve member 36 toward the valve seat 38 to maintain the valve in a closed position against the force of gravity. The valve member 32 of the first one-way valve 26 is generally seated on the valve seat 34 by the force of gravity, although a spring can be used to assist in the seating thereof. Although the first and second ends are shown as "upper" and "lower" ends respectively, it should be understood that they can be arranged in other configurations relative to each other and are not limited thereby. Accordingly, the terms "first" and "second" are not limited to "upper" and "lower" respectively, but can directed in other orientations.

The plunger 16 has first and second ends 42, 44 facing the first and second ends 22, 24 of the pumping chamber 14 respectively. A pump rod string 46 is connected to the first end 42 of the plunger. It should be understood that a portion (or entirety) of the rod string can be integrally formed with the plunger, or that plunger and rod can be made as separate parts and connected by various conventional and known devices.

Figure 5:
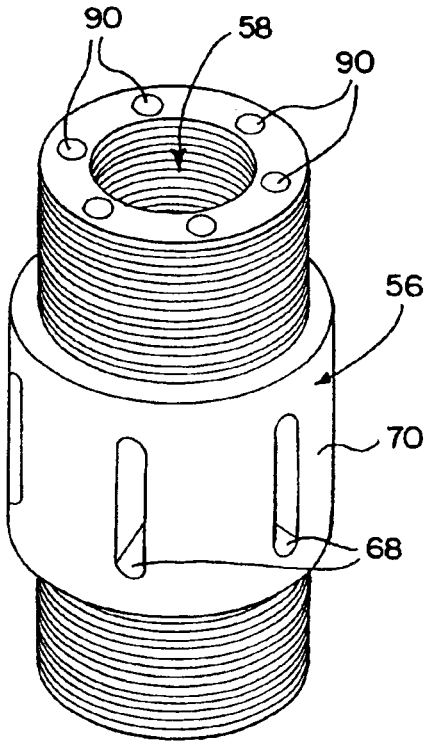
FIG. 5 is a perspective view of an inlet member.
Figure 6:
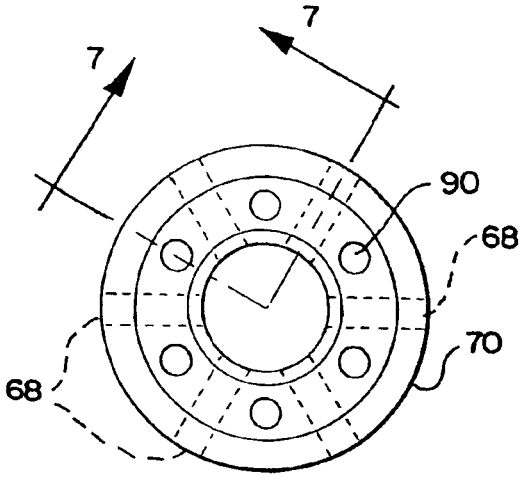
FIG. 6 is an end view of the inlet member.
Figure 7:
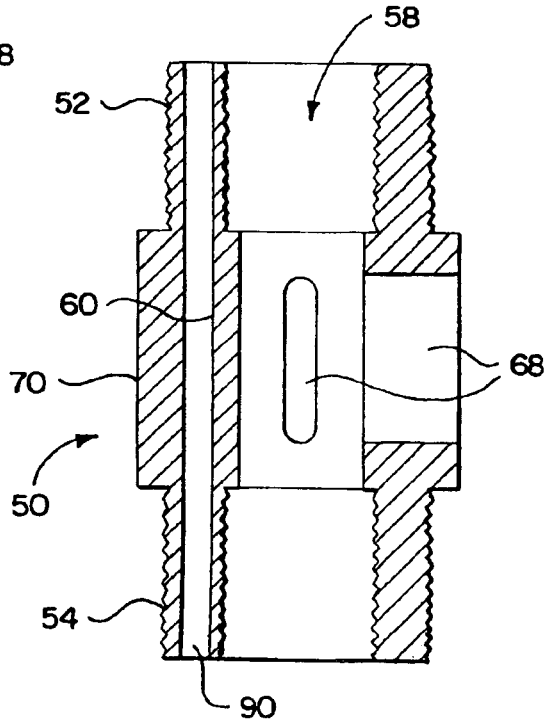
FIG. 7 is a cross-sectional view of the inlet member taken along line 7—7 of FIG. 6.

The barrel 12 is defined in part by a first, upper barrel member 48 and a second, lower barrel member 50 connected to a first and second end 52, 54 of a centrally located inlet member 56, shown in FIGS. 5–7. Preferably, the barrel members 48, 50 are threadably engaged with interior threads formed on upper and lower portions of the inner surface of an interior passageway 58 extending longitudinally through the center of the inlet member 56. It should be understood that the barrel members 48, 50 can be secured to the inlet member 56 in other ways, for example and without limitation by welding, adhesives, friction or snap-fits, and various clamping devices.

The first and second one-way valves 26, 28 are preferably secured to the first and second ends 18, 20 of the barrel by threadable engagement, although other securing devices as just described may also be employed. A sleeve 49, or top barrel portion, is secured to and extends upwardly from the upper end of the valve 26 or a seating nipple. It should be understood that the barrel 12 and pumping chamber 14 include and are defined at least in part by the upper and lower barrel members 48, 50 as well as the portion of the inlet member 56 forming the interior passageway 58 and which is connected to the upper and lower barrel members.

The plunger 16 slides up and down within the pumping chamber 14 and makes close contact with the interior surface of the barrel members 48, 50 and with the interior surface of a central annular portion 60 of the inlet member 56, which has an inner diameter substantially the same as the inner diameter of the barrel members 48, 50. A motor or other conventional drive device (not shown) well known in the art, preferably located at the surface, reciprocally moves the rod string 46 and plunger 16 in a first and second direction 64, 66 respectively.

Referring again to FIGS. 5–7, the inlet member 56 is preferably formed as a cylindrical member having a plurality of inlet passageways 68 formed in the central annular portion 60 that communicate between an exterior side surface 70 of the inlet member and the central, interior pumping passageway 58, which defines in part the pumping chamber 14. Preferably, the inlet passageways 68 extend transverse, and substantially perpendicular to, a longitudinal axis 72 of the pumping chamber, although they can be formed at any angle and with any contour. The exterior surface 70 of the annular portion of the inlet member is in fluid flow communication with the production zone 6 of the fluid 30 as shown in FIGS. 1–4.

Referring to FIGS. 1–7, a first, upper production tube member 74 is secured to first end 52 of the inlet member 56 and includes an interior surface 78 spaced from an exterior surface 80 of the first barrel member so as to define an annular passageway 86 therebetween. A second, lower production tube member 76 is secured to the second end 54 of the inlet member and includes an interior surface 82 spaced from the exterior surface 84 of the second barrel member so as to define an annular passageway 88 therebetween. The lower production tube member 76 has a bottom wall 77 that closes off the production tube and isolates the interior thereof to the production zone. The centrally located inlet member 56 further defines in part the production tube, and includes a plurality of fluid passageways 90 that communicate with the fluid passageways 86, 88 defined by the production tube 8 and barrel 12. Preferably, the fluid passageways 90 of the inlet member 56 extend longitudinally therethrough and are isolated from fluid flow communication with the inlet passageways 68 and interior passageway 58, which defines in part the pumping chamber 14. In one preferred embodiment, the sum of the cross-sectional areas of the inlet passageways 68 is greater than or equal to the sum of the cross-sectional areas of the fluid passageways 90 and the cross-sectional area of the smallest diameter of the interior passageway 58, although other configurations and ratios may be suitable.

Preferably, the plurality of fluid passageways 90 are positioned and spaced circumferentially around the center passageway 58 and are further successively staggered or spaced between the plurality of inlet passageways 68, as shown in FIG. 6. Of course, it should be understood that the inlet member 56 can be integrally formed with one or both of the barrel and production tubes 48, 50, 74, 76, and that those components are formed at least in part from the inlet member. It should also be understood that the inlet member can be configured with a single inlet passageway and/or a single fluid passageway, and that the six inlet passageways and six fluid passageways are meant to be exemplary. The term "plurality" as used herein means two or more.

The production tube 8 has a first, upper portion 92 in flow communication with the first end 22 of the pumping chamber and which receives fluid flowing through the first one-way valve 26. The production tube 8 also has a second, lower portion 94 in flow communication with the second end 24 of the pumping chamber and which receives fluid flowing through the second one-way valve 28. The fluid passageway 88, 90, 86 communicates between the first and second portions 92, 94. In addition, an outlet 100 communicates with the first portion 92. The fluid 30 is recovered from the outlet 100 for storage and transportation.

In operation, and referring to FIG. 1, the downhole pump 10 is shown with the plunger 16 in an initial, first, uppermost position, with the second end 44 of the plunger 16 positioned on a first side of the inlets 68, such that the fluid 30 from the production zone 6 flows into a lower pumping chamber 96. In this position, the fluid is in a dynamic state. The lower pumping chamber 96 is defined between the second end 44 of the plunger and the second end 24 of the pumping chamber. Accordingly, when the plunger 16 is in this position, the inlet 68 is in fluid communication with the second end 24 of the pumping chamber and the second one-way valve 28. In particular, the plunger 16 is positioned between the inlets 68 and the first end 22 of the pumping chamber so as to prevent fluid 30 from flowing into an upper pumping chamber 98 and to the first end 22 of the pumping chamber and the first one-way valve 26. The upper pumping chamber 98 is defined between the first end 22 of the pumping chamber and the first end 42 of the plunger.

As shown in FIG. 1, the length of the stroke, and the position of the plunger 16 can be controlled at the surface by controlling the stroke of the rod string 46. Therefore, first end 42 of the plunger can abut the upper end 22 of the pumping chamber, or can be spaced therebelow, when in the first position at the top of the stroke, depending on the length of the stroke.

Figure 2:
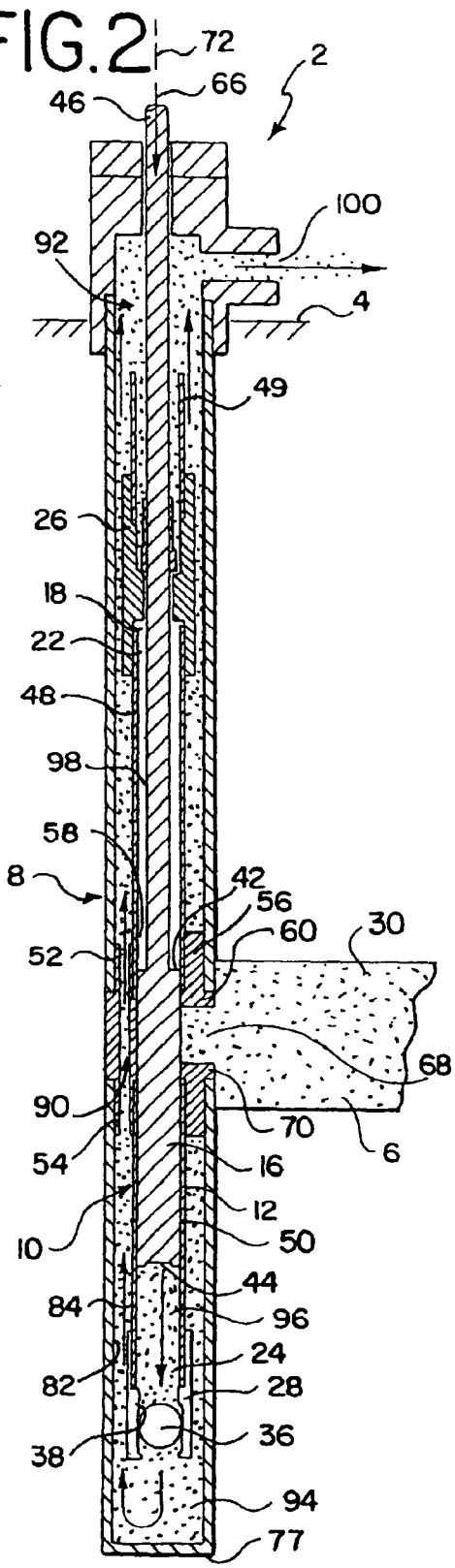
FIG. 2 is a cross-sectional side view of a downhole pump during the downstroke of the plunger.

Referring to FIG. 2, the rod string 46 and plunger 16 are moved in a downward direction 66 toward the second end 24 of the pumping chamber. As the plunger 16 moves past and closes the inlets 68, the second end 44 thereof pushes a volume of fluid collected in the lower pumping chamber 96 through the one-way valve 28 positioned at the second end 24 of the pumping chamber. During this phase, the fluid in the production zone 6 is in a static state. In certain preferred embodiments, the weight of the rod string 46 and plunger 16 have enough potential energy when in the first position to force the fluid 30 through the one-way valve 28 into the lower portion 94 of the production tube and to thereafter displace fluid in the fluid passageway 86, 88, 90 upwardly to the upper portion 92 of the production tube and eventually out of the outlet 100. During operation, the downstroke also pushes any sand or debris that has entered the pumping chamber 14, and in particular the lower pumping chamber 96, out through the second one-way valve 28. This prevents unnecessary wear on the lower half of the barrel, which is the most efficient.

Figure 3:
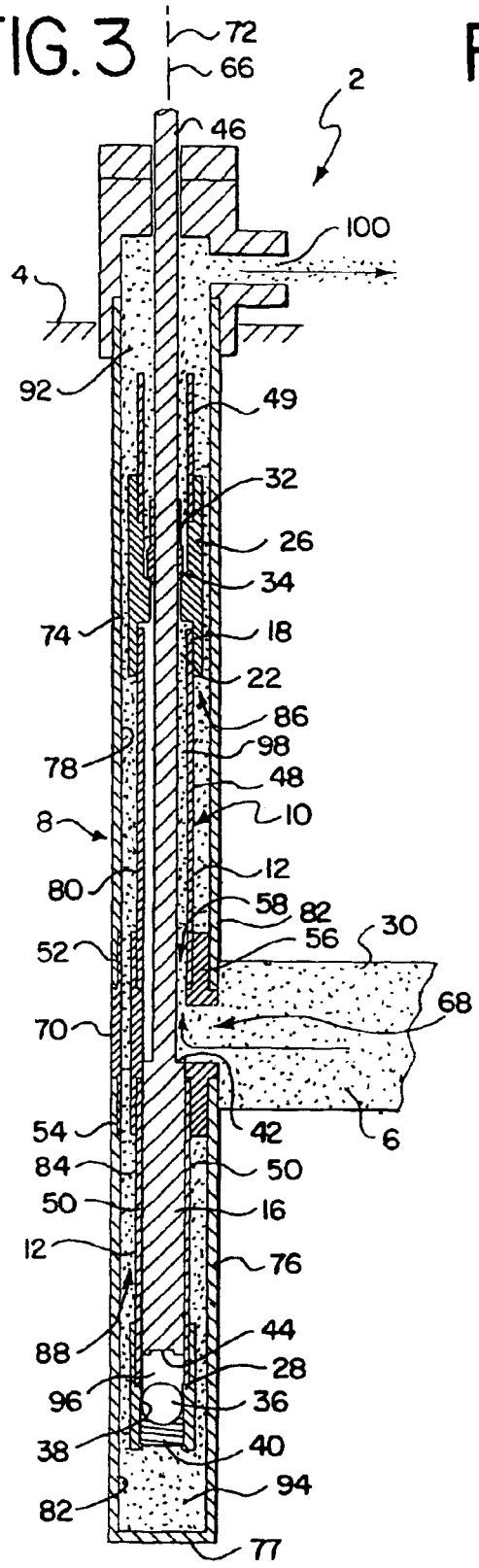
FIG. 3 is a cross-sectional side view of a downhole pump with the plunger positioned in a second position proximate the bottom of the stroke.

Referring to FIG. 3, the plunger 16 is shown at the bottom of the stroke, with the first end 42 of the plunger positioned on a second side of the inlets 68. It should be understood that reference to the positioning of the plunger on a first or second side of the inlets simply means that at least a portion of the inlets 68 are in communication with the pumping chamber 14, and that the phrase does not require that the inlets 68 be completely unobstructed by the plunger 14 or that the plunger 14 be completely on one side of the entirety of the inlet. For example, the positioning of the plunger on the second side of the inlet simply means that a least a portion of the inlets 68 has flow communication with the pumping chamber above the first end 42 of the plunger.

With the first end 42 of the plunger positioned on a second side of the inlets 68, fluid 30 from the production zone 6 flows into the upper pumping chamber 98 through the inlets 68, which are thereby in fluid communication with the first end 22 of the pumping chamber and the first one-way valve 26. At this juncture, the fluid in the production zone is in a dynamic state. The plunger 16 is positioned between the inlets 68 and the second end 24 of the pumping chamber so as to prevent fluid from flowing to the second end of the pumping chamber and the second one-way valve 28 positioned at the second end thereof. As shown in FIG. 3, the second end of the plunger 44 can abut the second end 24 of the pumping chamber, or can be spaced thereabove, when in the second position at the bottom of the stroke, depending on the length of the stroke.

Figure 4:
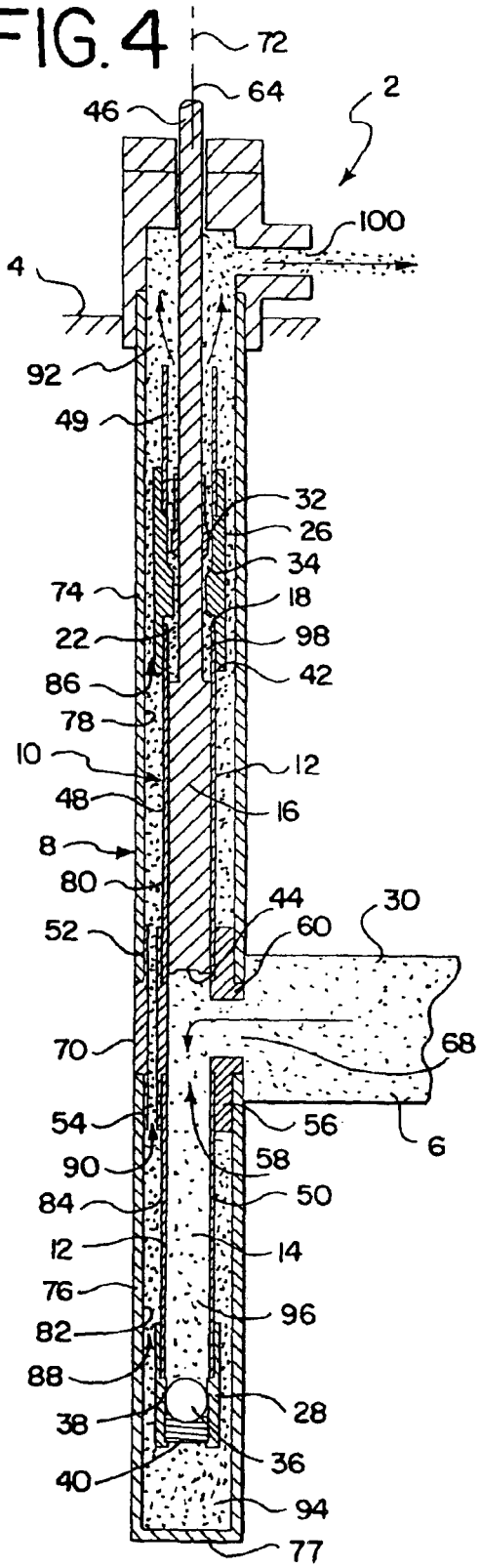
FIG. 4 is a cross-sectional side view of the downhole pump during the upstroke of the plunger.

Referring to FIG. 4, the rod string 46 and plunger 16 are next moved in an upward direction 64 toward the first end 22 of the pumping chamber. As the plunger 16 moves past and closes the inlets 68, such that the fluid in the production zone is in a static state, the first end 42 thereof pushes a volume of fluid collected in the upper pumping chamber 98 through the one-way valve 26 positioned at the first end 22 of the pumping chamber and into the upper portion 92 of the production tubing. The fluid discharged from the first one-way valve 26 thereafter displaces fluid in the upper portion 92 of the production tube and pushes fluid out of the outlet 100. Typically, the fluid in the lower portion of the production tube remains in a static state during this portion of the pumping cycle. Typically, the upstroke does not have as much pumping capacity as the downstroke, since the rod 46 takes up some of the volume in the upper pumping chamber 98. Since the downhole pump system pushes the fluid through both ends of the pumping chamber, the system avoids gas lock and the efficiency thereof is greatly improved.

As the plunger moves through the downstroke, as shown in FIGS. 2 and 3, a vacuum is created between the end 42 of the plunger and the end 18 of the barrel. As the end 42 of the plunger moves past the inlet openings 68, the vacuum is released and the fluid fills the upper pumping chamber. This action creates a thump, or dynamic/sonic wave, that can dislodge fluids, and in particular oil, from rocks and other underground objects in the production zone. Accordingly, it provides a mechanism for further facilitating the recovery of the oil from the production zone. Likewise, as the plunger moves through the upstroke, as shown in FIGS. 1 and 4, a vacuum is created between the end 44 of the plunger and the end 20 of the barrel. As the end 44 of the plunger moves past the inlet openings 68, the vacuum is released and the fluid fills the lower pumping chamber. This action creates a similar thump, or dynamic/sonic wave, as described above.

In one preferred embodiment, only the lower half of the pumping chamber 14, otherwise referred to as the lower pumping chamber 96, is used. In this embodiment, the plunger 16 never unblocks the inlets 68, or moves to the second side thereof, on the downstroke. As such, fluid 30 is not allowed into the upper pumping chamber 98 and the motor does not have to work as hard to lift the rod string 46 and plunger 16, since there is no fluid being carried thereby.

Figure 8:
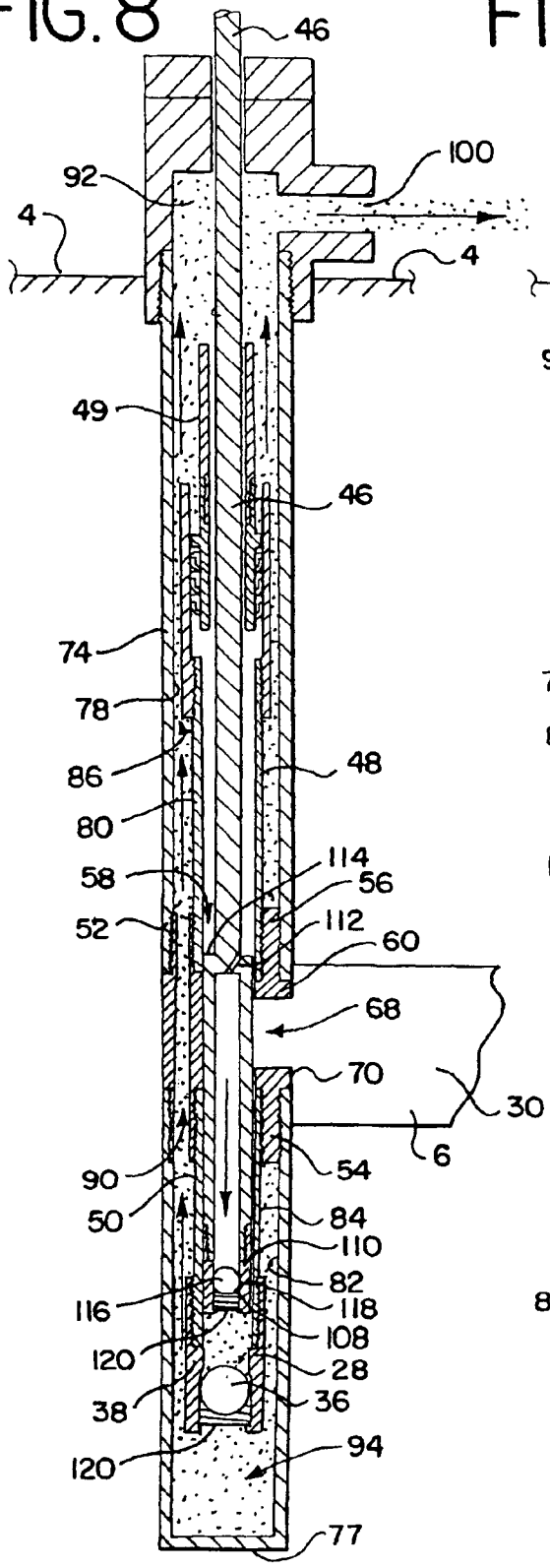
FIG. 8 is a cross-sectional view of an alternative embodiment of a downhole pump during the downstroke of the plunger.
Figure 9:
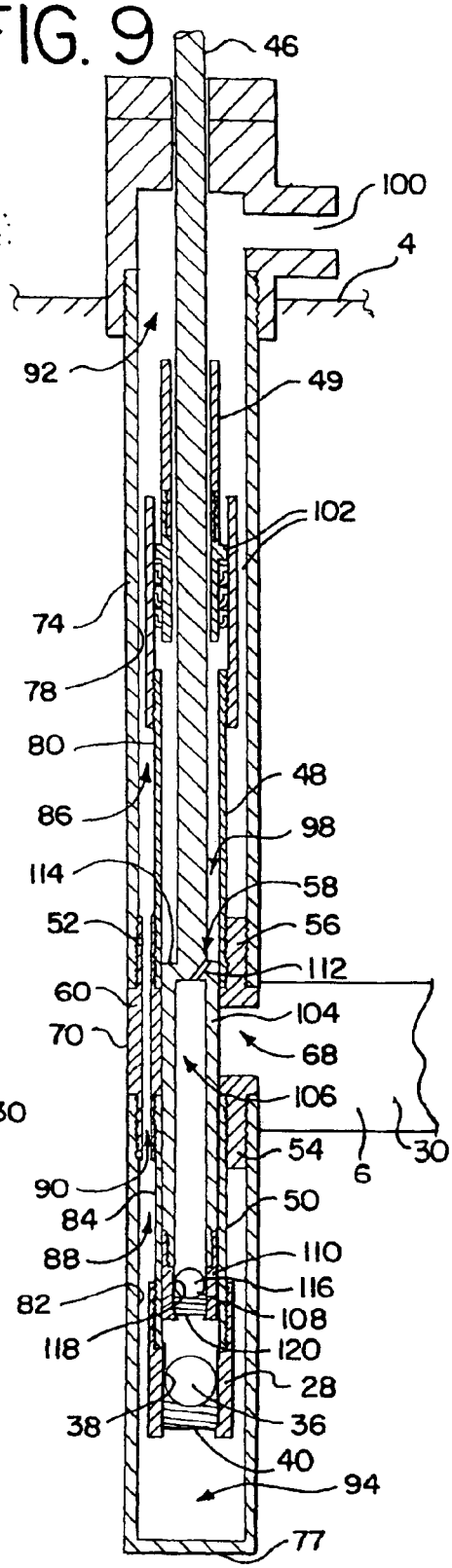
FIG. 9 is a cross-sectional view of the downhole pump shown in FIG. 8 with the plunger positioned near the bottom of the stroke.

Referring to the alternative embodiment of FIGS. 8 and 9, the upper one-way valve is eliminated. Components similar to those of the embodiment shown in FIGS. 1–4 are labeled with the same reference numbers. In this embodiment, the pump functions in the same way as the above-described double-stroke pump when using only the lower half thereof, i.e., when pumping fluid only on the downstroke. In this embodiment, the rod string 46 is sealed against a seating nipple 102 positioned at the top of the barrel 12. A plunger 104 has a hollow cavity 106 formed therein, with a one-way valve 108 located at the bottom end 110 of the plunger. In one embodiment, the valve 108 has a valve member 116, valve seat 118 and a spring 120. A weep hole 112 communicates between the cavity 106 and the upper pumping chamber 98. Fluid, such as oil, that accumulates above the top end 114 of the plunger drains through the weep hole 112 into the cavity 106. The drained fluid is then drained through the one-way valve 108 into the lower portion 94 of the production tube on the upstroke of the plunger.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A downhole pump comprising:

a pump barrel defining a pumping chamber having a first end and a second end;

a first one-way valve positioned at said first end of said pumping chamber, said first one-way valve operable to permit a flow of fluid out of said first end of said pumping chamber;

a second one-way valve positioned at said second end of said pumping chamber, said second one-way valve operable to permit a flow of fluid out of said second end of said pumping chamber; and a plunger movably disposed in said pumping chamber and having first and second ends facing said first and second ends of said pumping chamber respectively;

wherein said pumping chamber has an inlet adapted to be in flow communication with a production zone and wherein said plunger is movable in said pumping chamber between at least a first position and a second position, wherein said second end of said plunger is positioned on a first side of said inlet when said plunger is in said first position such that said inlet is in flow communication with said second end of said pumping chamber, and wherein said first end of said plunger is positioned on a second side of said inlet when said plunger is in said second position such that said inlet is in flow communication with said first end of said pumping chamber.

2. The downhole pump of claim 1 further comprising a production tube surrounding said pump barrel and in fluid flow communication with said first and second ends of said pumping chamber.

3. The downhole pump of claim 2 wherein said production tube comprises a lower portion communicating with said second end of said pumping chamber, an upper portion communicating said with first end of said pumping chamber, and a fluid passageway in fluid flow communication between said lower and upper portions of said production tube.

4. The downhole pump of claim 3 comprising an inlet member having an interior chamber defining at least in part said pumping chamber and at least one fluid conduit isolated from said interior chamber and defining at least in part said fluid passageway of said production tube, wherein said inlet member defines said inlet to said pumping chamber, and wherein said inlet is isolated from said at least one fluid conduit.

5. The downhole pump of claim 4 wherein said pump barrel comprises a first barrel member connected to a first end of said inlet member and a second barrel member connected to a second end of said inlet member.

6. The downhole pump of claim 5 wherein said production tube comprises a first tube member connected to a first end of said inlet member and a second tube member connected to a second end of said inlet member.

7. The downhole pump of claim 1 wherein said pumping chamber has a plurality of inlets.

8. The downhole pump of claim 1 further comprising a reciprocally moving pump rod connected to said plunger.

9. A downhole pump comprising:

a pump barrel defining a pumping chamber having an upper end and a lower end;

a one-way valve positioned at said lower end of said pumping chamber, said one-way valve operable to permit a flow of fluid out of said lower end of said pumping chamber and to restrict a flow of fluid into said lower end of said pumping chamber;

a plunger movably disposed in said pumping chamber and having an end facing said lower end of said pumping chamber; and a production tube surrounding said pump barrel and in fluid flow communication with said lower end of said pumping chamber;

wherein said pumping chamber has an inlet adapted to be in flow communication with a production zone and wherein said end of said plunger is movable in said pumping chamber between at least a first position and a second position, wherein said end of said plunger is positioned above said inlet when said plunger is in said first position such that said inlet is in flow communication with said lower end of said pumping chamber, and wherein said end of said plunger is positioned below said inlet when said plunger is in said second position, and wherein said plunger is operable to force fluid through said one-way valve positioned at said lower end of said pumping chamber as said plunger is moved from said first position to said second position.

10. An inlet member for use in a downhole pump comprising:

a housing having a side exterior surface, a first end, a second end, an interior pumping passageway formed therein between and in fluid communication with said first and second ends, at least one fluid passageway formed therein between and in fluids communication with said first and second ends, and at least one inlet passageway communicating between an exterior of said housing and said interior pumping passageway, wherein said at least one fluid passageway is in fluid flow isolation with said interior pumping passageway and said inlet passageway.

11. The inlet member of claim 10 wherein said housing comprises a plurality of fluid flow passageways.

12. The inlet member of claim 11 wherein said housing is cylindrical and wherein said interior pumping passageway extends along a central longitudinal axis of said housing, and wherein said at least one fluid flow passageways comprises a plurality of fluid flow passageways positioned circumferentially around said interior pumping passageways.

13. The inlet member of claim 10 wherein said at least one inlet passageway comprises a plurality of inlet passageways.

14. The inlet member of claim 10 wherein said housing has a central annular portion, wherein said at least one inlet is formed in said central annular portion, and wherein said first and second ends of said housing are cylindrical and have internal and external threading formed thereon.

15. An inlet member for use in a downhole pump comprising:

a housing having a side exterior surface, a first end, a second end, an interior pumping passageway formed therein between said first and second ends, at least one fluid passageway formed therein between said first and second ends, and at least one inlet passageway communicating between an exterior of said housing and said interior pumping passageway, wherein said at least one fluid passageway is in fluid flow isolation with said interior pumping passageway and said inlet passageway, wherein said housing is cylindrical and wherein said interior pumping passageway extends along a central longitudinal axis of said housing, and wherein said at least one fluid flow passageways comprises a plurality of fluid flow passageways positioned circumferentially around said interior pumping passageways, and wherein said at least one inlet passageway comprises a plurality of inlet passageways communicating with said interior pumping passageway, wherein said plurality of said inlet passageways are successively positioned between said plurality of said fluid flow passageways.

16. A method of pumping fluid from a production zone located beneath the surface of the earth comprising:

positioning a downhole pump in the ground, wherein said downhole pump comprises a pump barrel defining a pumping chamber having a first end and a second end and an inlet in flow communication with the production zone; a first one-way valve positioned at said first end of said pumping chamber; a second one-way valve positioned at said second end of said pumping chamber; and a plunger movable in said barrel in a first and second direction and having first and second ends facing said first and second ends of said pumping chamber respectively;

positioning said plunger in a first position wherein said second end of said plunger is positioned on a first side of said inlet;

allowing a first volume of fluid to flow into said pumping chamber from said inlet;

moving said plunger in said second direction and thereby forcing at least a portion of said first volume of fluid from said pumping chamber through said second one-way valve positioned at said second end of said pumping chamber;

positioning said plunger in a second position wherein said first end of said plunger is positioned on a second side of said inlet;

allowing a second volume of fluid to flow into said pumping chamber from said inlet; and moving said plunger in said first direction and thereby forcing at least a portion of said second volume of fluid through said first one-way valve positioned at said first end of said pumping chamber.

17. The method of claim 16 further comprising providing a production tube surrounding said pump barrel and in fluid flow communication with said first and second ends of said pumping chamber.

18. The method of claim 17 wherein said production tube comprises a lower portion communicating with said second end of said pumping chamber, an upper portion communicating said with first end of said pumping chamber, and a fluid passageway in fluid flow communication between said lower and upper portions of said production tube, and wherein said forcing said at least said portion of said first volume of fluid from said pumping chamber through said second one-way valve positioned at said second end of said pumping chamber comprises forcing fluid from said lower portion of said production tube to said upper portion of said production tube.

19. The method of claim 18 wherein said downhole pump comprises an inlet member having an interior chamber defining at least in part said pumping chamber and at least one fluid conduit isolated from said interior chamber and defining at least in part said fluid passageway of said production tube, wherein said inlet member defines said inlet to said pumping chamber, and wherein said inlet is isolated from said at least one fluid conduit.

20. The method of claim 19 wherein said pump barrel comprises a first barrel member connected to a first end of said inlet member and a second barrel member connected to a second end of said inlet member.

21. The method of claim 20 wherein said production tube comprises a first tube member connected to a first end of said inlet member and a second tube member connected to a second end of said inlet member.

22. The method of claim 16 wherein said pumping chamber has a plurality of inlets in flow communication with the production zone.

* * * * *